United States Patent [19]

Pham

[11] Patent Number: 4,743,534

[45] Date of Patent: May 10, 1988

[54] PREFORMED SILVER HALIDES FOR PHOTOTHERMOGRAPHIC SYSTEM

[75] Inventor: Oanh V. Pham, St. Paul, Minn.

[73] Assignee: Minnesota Mining and Manufacturing Company, St. Paul, Minn.

[21] Appl. No.: 796,725

[22] Filed: Nov. 8, 1985

Related U.S. Application Data

[63] Continuation of Ser. No. 556,578, Nov. 30, 1983, abandoned.

[51] Int. Cl.[4] ..... G03C 1/02

[52] U.S. Cl. ..... 430/619; 430/620; 430/353; 430/627

[58] Field of Search ..... 430/619, 620, 627, 569, 430/353

[56] References Cited

U.S. PATENT DOCUMENTS

| | | | |
|---|---|---|---|
| 3,003,879 | 10/1961 | Priest et al. | 96/114 |
| 3,713,833 | 1/1973 | Lindholm et al. | 96/114 |
| 3,871,887 | 3/1975 | Jones | 96/67 |
| 4,242,445 | 12/1980 | Saito | 430/569 |

FOREIGN PATENT DOCUMENTS 1362970 8/1974 United Kingdom .

OTHER PUBLICATIONS

*Research Disclosure* 17643, Dec. 1978, pp. 22–23.

J. W. Shepard, "Early Dry Silver Technology at 3M", *Journal of Applied Photographic Engineering*, vol. 8, No. 5, Oct. 1982.

*Primary Examiner*—Won H. Louie

*Attorney, Agent, or Firm*—Donald M. Sell; James A. Smith; David W. Anderson

[57] ABSTRACT

Method for preparing photosensitive silver halide crystals. A binder resin, a source of halide ions, and a source of silver ions are dissolved in an organic solvent, e.g., ethanol. Silver halide nuclei will then form. Additional source of halide ions and additional source of silver ions can be added to the solution in incremental additions, so that the initially-formed silver halide nuclei will grow. Upon removal of the solvent, the silver halide crystals will exist in a dry state, entrapped in the binder resin. Silver halide crystals formed and grown in this manner can be used to prepare photothermographic imaging compositions, which compositions will exhibit higher speed than photothermographic imaging compositions containing silver halide crystals grown according to conventional methods.

3 Claims, 1 Drawing Sheet

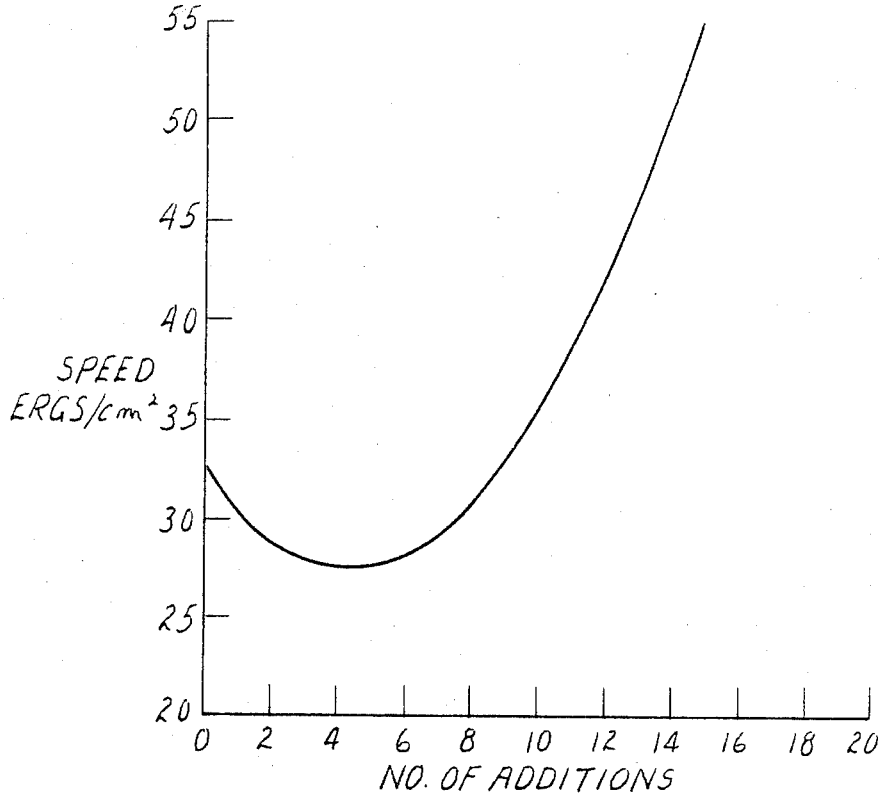
55
50
45
40
SPEED
ERGS/cm²
35
30
25
20
0
2
4
6
8
10
12
14
16
18
20
NO. OF ADDITIONS

PREFORMED SILVER HALIDES FOR PHOTOTHERMOGRAPHIC SYSTEM

This is a continuation of application Ser. No. 556,578, filed Nov. 30, 1983, abandoned.

BACKGROUND OF THE INVENTION

This invention relates to a method for growing silver halide crystals. Silver halide crystals grown by this method can be used in photothermographic systems.

In the formation of photothermographic imaging materials, photosensitive silver halide salts have been combined with the substantially light-insensitive silver salts. The light-insensitive silver salts are generally salts of fatty acids. The photosensitive silver halide forms silver when struck with light, and this silver is catalytic to the reduction of the light-insensitive silver salts. Silver halide generally has been placed in catalytic proximity to the silver salts of fatty acids by physical admixture of the halide salt and organic salt (e.g., U.S. Pat. No. 3,152,904), mixture of preformed silver halide into the precipitating solution for the organic silver salt (e.g., U.S. Pat. No. 3,839,049) and in situ halidization of the dried or coated silver salt of fatty acids (e.g., U.S. Pat. No. 3,457,075).

All of these various methods of producing photothermographic materials require the same materials to be present in the structure and may use the same addenda for modification of sensitometric properties. The required material, in addition to the silver halide in catalytic proximity to the silver salt of an organic fatty acid, is the reducing agent for silver ions. Organic reducing agents, particularly organic photographic developers such as hydroquinone, methyl gallate, catechol, phenylene diamine, p-aminophenol and phenidone, are useful. The hindered phenol reducing agents are the most preferred. Amongst the addenda which may be used in the diverse photothermographic emulsions produced by these processes are toning agents (e.g., U.S. Pat. Nos. 3,392,020; 3,446,648; 3,667,958), sensitizers and sensitizing dyes (e.g., U.S. Pat. Nos. 3,679,422; 3,666,477; 3,761,279; 3,719,495), color couplers (e.g., U.S. Pat. No. 3,531,286), decolorizable light absorbers (e.g., U.S. Pat. No. 3,745,009), mercury compounds (e.g., U.S. Pat. No. 3,589,903), etc.

Although silver halide can be provided to the photothermographic imaging system by in situ halidization of the silver salt of fatty acids, it is preferable to introduce preformed silver halide into the imaging system for the following reasons:

(1) the size and distribution thereof of preformed silver halide grains are subject to better control than the size and distribution of silver halide grains formed in situ;

(2) preformed silver halide grains permit better variation and control of the sensitometric properties of photothermographic systems than do silver halide grains formed in situ;

(3) the light sensitive portion of the photothermographic system can be kept separate from the heat sensitive portion of the system until the time for use, thus allowing the application of heat to promote grain growth;

(4) the light sensitive portion of the photothermographic system can be modified, sensitized, or discarded without affecting the heat sensitive portion of the system.

British Patent Specification No. 1,362,970 discloses a method of preparing preformed silver halide grains suitable for use in a photosensitive heat-processable photographic material by mixing a liquid composition comprising an ionizable silver salt, a hydrophobic polymer peptizer or a polyethylene glycol peptizer, and a solvent, with a liquid composition comprising an ionizable halide and a solvent until the silver halide is formed. The thus-formed silver halide is thereafter mixed with a light-insensitive reducible metal compound, and a reducing agent therefor, and the resulting composition is coated on a support. The ionizable silver salt, e.g., silver nitrate, is typically dissolved in water. The polymer peptizer, generally polyvinyl butyral, and the solvent, e.g., acetone and toluene, are mixed with the aqueous solution for ionizable silver salt. A water-in-oil dispersion is produced by mixing these components. According to Patent Specification No. 1,362,970, it is believed that the silver halide grains form at the interface between the water droplets and the surrounding organic medium when ionizable halide and its solvent are added to the water-in-oil dispersion. Regardless of the mechanism of grain growth, the method of Patent Specification No. 1,362,970 suffers from the shortcoming that controlling the size of the silver halide grain is difficult. Control of grain size is important because grain size and grain size distribution affect film speed.

U.S. Pat. No. 3,871,887 discloses a method of preparing a photosensitive silver halide by mixing lithium bromide, silver trifluoroacetate and poly(vinyl butyral) in acetone under controlled conditions. The resulting, fine-grain silver bromide can then be mixed with an oxidation-reduction image-forming combination to provide a photothermographic material. The method fails to disclose how one could control grain size and grain size distribution. Furthermore, silver trifluoroacetate is relatively unstable when compared with such sources of silver ions as silver nitrate.

SUMMARY OF THE INVENTION

This invention involves a novel process for manufacturing preformed silver halide grains which are useful in manufacturing photothermographic sheets, films, and the like.

According to this process, a binder resin, a source of halide ions, and a source of silver ions are introduced in an inert organic solvent and mixed. Silver halide grains form, grow, and ripen. Additional source of halide ions and additional source of silver ions are then introduced into the organic solvent in stepwise manner, i.e. in incremental additions, rather than in continuous manner, in order to allow the formed grains to grow. When the grains attain the appropriate size, the solution is washed and the solvent removed. The silver halide grains are trapped in the binder resin and exist in a dry state. If, at some later time, larger silver halide grains are desired, the binder containing the dry crystals can be redissolved in the solvent, and the growth process restarted by adding in incremental additions a source of silver ions or a source of halide ions or both. The silver halide grains formed in this manner can be added to an emulsion that is suitable for use as a photothermographic composition. The preformed silver halide grains added to the emulsion act as the photosensitive part of the photothermographic composition.

Advantages of the process of this invention are that the size distribution of the silver halide grains can be controlled with a high degree of accuracy, and the silver halide grains entrapped in the binder resin will remain stable even after being stored for long periods of time. Furthermore, film speed can be varied by more than a factor of 10 by controlling the size of the silver halide grains.

BRIEF DESCRIPTION OF THE DRAWING

FIG. 1 is a graphical representation which depicts how the number of incremental equal additions of silver source and halide source, the total of said additions being fixed regardless of the number of incremental additions, affects the speed of a photothermographic element containing the photosensitive silver halide.

DETAILED DESCRIPTION

The binder resin is a hydrophobic polymer that is soluble in inert organic solvents. It is preferred that the binder resin be the same as, or compatible with, the resin used with the photothermographic dispersion. The use of the same resin is more preferred because it results in better contact between silver halide and silver salt of fatty acid, thus providing a better dispersion. The preferred binder resins are polyvinyl acetals, such as polyvinyl butyral and polyvinyl formal. The most preferred binder resin is polyvinyl butyral, because it readily fluidizes silver behenate. Other resins, such as cellulose acetate and polyvinyl alcohol, can also be used.

The source of silver ions can be ionizable silver salts. Ionizable silver salts are well-known in the art, and include, for example, silver nitrate and silver perchlorate.

The source of halide ions can be ionizable halide salts. Ionizable halides are well-known in the art, and include, for example, inorganic halides, such as zinc bromide, zinc chloride, ammonium bromide, ammonium chloride, lithium bromide and mixture thereof, and organic halides, preferably alkane halides, having from 1 to 12 carbon atoms, such as 1-bromooctane, 2-bromooctane, and 1-bromobutane.

Inert organic solvents that are suitable for this invention include those wherein both the source of silver ions and the binder resin are soluble. Representative examples of these solvents are alcohols having from 1 to 4 carbon atoms, ketones having from 1 to 4 carbon atoms, benzene, toluene, and mixtures thereof. The solvent of preference, however, is ethanol, because silver nitrate, sources of halide ion, and polyvinyl butyral are soluble therein.

The method for preparing the preformed silver halide grains involves first dissolving the binder resin in an inert organic solvent. The solution is preferably mixed to insure that a stable solution is formed. An ionizable silver salt, e.g. silver nitrate, and an ionizable halide, e.g. zinc bromide, are introduced into the solution containing the binder resin. Mixing is preferably continued to provide homogeneity to the solution. The ionizable silver salts can be introduced in solid form, e.g., powdered, crystalline, or in solution form, i.e., dissolved in the same inert solvent used to dissolve the binder resin or in an inert solvent compatible with the solvent used to dissolve the binder resin. The ionizable halide can be introduced in crystalline form or in solution form. If introduced in solution form, the solvent should be either the same inert solvent as that used to dissolve the binder resin or an inert solvent compatible with the solvent used to dissolve the binder resin. The ionizable silver salt and ionizable halide can be introduced into the binder resin solution simultaneously, or either the silver salt or the halide can be introduced first. It is important to introduce the ionizable silver salt and the ionizable halide in incremental additions rather than in continuous manner, so that the first-formed silver halide grains can grow under controlled conditions. If the ionizable silver salt and ionizable halide are introduced in continuous manner, additional silver halide nuclei will form more rapidly than the first-formed silver halide grains can grow, thus resulting in fine grain silver halide with no ability to increase in size. It is preferable to first introduce the silver salt, then add sufficient halide to react with the silver salt, and then, if necessary, introduce additional silver salt before adding additional halide. However, the source of halide ions can be added prior to adding the silver salt if so desired.

For each 100 equivalents of silver halide nucleus, a total of from about 50 to about 500 equivalents of silver ion and a total of from about 50 to about 500 equivalents of halide ion, added incrementally, will provide enhanced speed, the ratio of the amount of silver ion to the amount of halide ion in each incremental addition preferably being approximately 1:1. Below the lower limits, the amount of silver ions and halide ions are not sufficient to significantly affect the size of the silver halide nucleus. Above the upper limits, the amount of silver ions and halide ions usually exceeds the capacity of conventional mixing vessels and agitation becomes difficult. Preferably, a total of about 200 equivalents silver ion and a total of about 200 equivalents halide ion are added incrementally to 100 equivalents initial silver halide nucleus to provide the most efficient, or optimum, increase in speed, based upon total amount of silver ion and halide ion utilized. The amounts to be added are preferably, but not necessarily, divided into one to sixteen equal or substantially equal portions for incremental addition. More preferably, for 100 equivalents of initial silver halide nucleus, about 50 equivalents of silver ion and about 50 equivalents of halide ion are added in each incremental addition.

Silver halide grains formed initially upon the addition of an ionizable silver salt and an ionizable halide to the solution containing the binder resin will grow as more additions of silver ions and halide ions are made. When the grains have attained the desired size, which size can be measured by using an electron micrograph, x-ray diffraction, turbidity methods, color indicators, or the like, the solution can be washed, preferably with deionized water, to remove excess solvent. Removal of excess solvent can be accelerated by, for example, centrifugation, pressing, as by a filter press. The thus-formed silver halide grains will be trapped in the binder resin and will exist in a dry form. When in this dry form, the silver halide grains will not ripen or grow, thus allowing storage for long periods of time prior to actual use in a photothermographic system. Alternatively, the unwashed silver halide grains can be added directly to a photothermographic emulsion containing a silver salt of a fatty acid and a binder. However, the direct addition of unwashed silver halide introduces foreign ions into the emulsion, and, thus, is not preferred.

If, for some reason, the silver halide grains entrapped in the binder resin, i.e., the preferred, dry form embodiment, are not of sufficient size for a particular application, the grain-containing resin can be redissolved in the solvent, and the grain-growing process can be restarted at the point where it was stopped. This process can be repeated as many times as needed. The grain size preferable for most conventional photothermographic compositions ranges from about 0.02 to about 0.36 micrometers (μm). Control of the size of the silver halide grain is important because grain size affects film speed. As grain size increases, film speed also increases. Furthermore, grain size distribution affects optical density and image contrast.

The dried resin-entrapped silver halide grains can be added directly to a photothermographic emulsion which contains an oxidation-reduction image-forming system comprising (1) a light-insensitive reducible metal compound (e.g. a silver salt of a fatty acid), and (2) a reducing agent therefor. The emulsion can optionally, and preferably, contain developers, sensitizing dyes, antifoggants, stabilizers, and solvents.

The emulsion can then be applied to a suitable support, for example, polymeric film or paper, by conventional means, for example, knife coating, wire-wound rod coating.

The emulsion layer can be overcoated with a protective layer. Such a protective layer can contain (1) a resin, e.g., one having a high melting point, (2) development accelerators, e.g., phthalazine, 4-methyl phthalic acid, tetrachlorophthalic acid, tetrachlorophthalic anhydride, (4) antifogging agents, (5) other additives commonly employed in photothermographic systems.

The method of the present invention provides preformed silver halide grains in a dry state. The silver halide is neither dissolved in a solvent nor dispersed in a liquid medium. Among the advantages resulting from the process of this invention are (1) the enhanced capability for controlling the size of preformed silver halide grains, which allows control and improvement, i.e. increase, of film speed, (2) elimination of ripening or growth of the silver halide grains during storage, which allows the silver halide to be stored for long periods of time prior to actual use, and (3) the capability of preparing photothermographic film in a relatively short period of time. The in situ method of preparing photothermographic film requires a period of about six to eight hours. By using the preformed silver halides prepared by the present method, the film can be prepared in a period of one to two hours. The preformed silver halide will act as the photosensitive portion of the photothermographic material. The following non-limiting examples will serve to illustrate the invention.

EXAMPLE I

This example demonstrates the effect of one incremental addition of silver ions and halide ions to photosensitive silver halide nuclei on the speed of a photothermographic element prepared with said silver halide.

Polyvinyl butyral (Butvar® B-76, available from Monsanto Company) (10 g) and ethanol (90 g) were introduced into a stainless-steel beaker equipped with a stirrer. The resulting solution was stirred at 100 R.P.M. and held at a temperature of 20° C. Simultaneously, 0.5 g of silver nitrate dissolved in 20 g of ethanol and 0.33 g of zinc bromide dissolved in 2.5 g of ethanol were added to the polyvinyl butyral/ethanol solution. The thus-formed dispersion was stirred for an additional one hour.

The dispersion was poured into a pail containing 5 gallons of deionized water. The ethanol was leached out by the water, and the polyvinyl butyral and silver bromide entrapped therein floated to the surface of the water. The resin was removed from the pail, and excess ethanol was removed by means of squeezing. The yellow color of the washed material, and the shift in the color of the solution from colorless to cloudy, and then to yellow during the growing step indicated the presence of silver bromide in polyvinyl butyral.

Half of the polyvinyl butyral and silver bromide entrapped therein was added to a photothermographic emulsion containing the following ingredients in the amounts indicated:

| Ingredient | Amount (g) |
|---|---|
| Silver behenate homogenized in solvent comprising 80% methyl ethyl ketone: 20% toluene (12% solids) | 80.00 |
| Silver behenate and behenic acid homogenized in acetone (13% silver; 12.5% solids) | 40.00 |
| Toluene | 43.00 |
| Polyvinyl butyral (Butvar® B-76) | 20.00 |
| Antioxidant [2-2'-methylenebis-(4-methyl 6-tertiary butyl phenol)] | 3.50 |
| Sensitizing dye (merocyanine) | 0.005 |
| Antifoggant (mercuric acetate in 3 ml of methanol) | 0.100 |
| Antifoggant (mercuric bromide in 1 ml of methanol) | 0.100 |

The resulting solution was coated onto a paper substrate by means of knife coater to a uniform coating weight of 1 g/ft$^2$. The solution was allowed to dry for 3½ minutes at a temperature of 80° C.

A composition consisting of the following ingredients in the amount indicated was coated over the silver salt-containing layer in order to form a protective coating:

| Ingredient | Amount (g) |
|---|---|
| Acetone | 68.0 |
| Methanol | 11.5 |
| Methyl ethyl ketone | 15.0 |
| Cellulose acetate | 4.5 |
| Phthalazine | 0.5 |
| 4-Methyl phthalic acid | 0.36 |
| Tetrachlorophthalic acid | 0.11 |
| Tetrachlorophthalic anhydride | 0.085 |

The protective coating solution was coated to a uniform coating weight of 0.25 to 0.3 g/ft$^2$ and allowed to dry for 3½ minutes at a temperature of 80° C.

The photothermographic element thus-formed was exposed through a continuous density wedge with a xenon flash for a period of one microsecond. After exposure, the element was processed with a hot roll at 275° F. at a dwell time of 5 seconds.

The image obtained in this and the following examples had a Dmax of 1.6 and a Dmin of 0.12. At D=1.0, the film speed was 60 ergs/cm$^2$.

EXAMPLE II

This example demonstrates the effect of two incremental additions of silver ions and halide ions to photosensitive silver halide nuclei on the speed of a photothermographic element prepared with said photosensitive silver halide.

Polyvinyl butyral (Butvar® B-76) (10 g), silver nitrate (2.16 g) and ethanol (88.0 g) were introduced into a stainless steel beaker equipped with a stirrer. The resulting solution was stirred at 100 R.P.M. while a temperature of 20° C. was maintained. Zinc bromide (1.43 g) dissolved in 4.0 g of ethanol was added to the solution and silver bromide crystals formed. After a period of 15 minutes, silver nitrate powder (1.0 g) (90 μm mean average particle size) was then added to the solution. Fifteen minutes later zinc bromide (0.66 g) dissolved in 1.5 g of ethanol was added to the solution. After the solution was stirred for one hour, the silver bromide product was washed and dried as in Example I. A photothermographic element was prepared with the silver bromide product according to the procedure of Example I. At D=1.0, the film speed was 40 ergs/cm$^2$.

EXAMPLE III

This example demonstrates the effect of temperature on formation of silver halide grains.

The procedure of Example II was repeated, the only exception being that the formation of the silver halide grains was conducted at a temperature of 30° C. A photothermographic element containing the photosensitive silver halide of this example was prepared and imaged according to the method of Example I. The photothermographic element exhibited a higher film speed (speed=20 ergs/cm$^2$ at D=1.0) than the element of Example II.

EXAMPLE IV

This example demonstrates the use of an organic halide as the source of halide ions. The procedure of Example II was repeated, the only exception being that n-bromooctane was used in place of zinc bromide. A photothermographic element containing the photosensitive silver halide of this example was prepared and imaged according to the method of Example I. The photothermographic element formed exhibited a speed 10 times greater than the speed of the element of Example II.

EXAMPLE V

This example demonstrates how varying the particle size of silver nitrate powder used to form the photosensitive silver halide affects the speed of a photothermographic element containing the photosensitive silver halide. The procedure of Example II was repeated, the only exception being that the silver nitrate powder had a mean particle size of 45 μm. A photothermographic element containing the photosensitive silver halide of this example was prepared and imaged according to the method of Example I. The photothermographic element exhibited a higher speed (speed=25 ergs/cm$^2$ at D=1.0) than element Example II.

EXAMPLE VI

This example demonstrates how varying the size of the silver halide grain affects the speed of a photothermographic element formed therewith.

The procedure of Example II was repeated. Electron micrograph measurement indicated that the majority of the grains were of a size of 0.1 μm. The polyvinyl butyral binder which entrapped the silver halide was redissolved in ethanol. Silver nitrate powder (1.0 g) having a mean particle size of 45 m was added to the solution. Zinc bromide (0.66 g dissolved in 1.5 g ethanol), was then added to the solution. The solution was stirred for 15 minutes. Then, 1.0 g of silver nitrate powder was added. The solution was stirred another 15 minutes. Then 0.66 g of zinc bromide dissolved in 1.5 g ethanol was added, and the solution was allowed to ripen for one hour. The silver halide grains were washed and dried as in Example II. A photothermographic element containing the photosensitive silver halide of this example was prepared and imaged according to the method of Example I.

Electron micrographic measurement indicated that the majority of the grains were of a size of 0.2 μm, and the speed of a photothermographic element containing these grains (speed=15 ergs/cm$^2$ at D=1.0) was higher than that of the element containing grains having a size of 0.1 μm (speed=40 ergs/cm$^2$ at D=1.0).

EXAMPLE VII

This example demonstrates the use of ammonium bromide as the source of halide ions. The procedure of Example II was repeated, the only exception being that ammonium bromide was used instead of zinc bromide. A photothermographic element containing the photosensitive silver halide of this example was prepared and imaged according to the method of Example I. The speed of the photothermographic element formed with these grains was similar to that of the element in Example II.

EXAMPLE VIII

This example demonstrates the formation of silver chloride grains. The procedure of Example VII was repeated, the only exception being that zinc chloride was used instead of zinc bromide. The silver chloride grains were white. A photothermographic element containing the photosensitive silver halide of this example was prepared and imaged according to the method of Example I. The speed of the photothermographic element formed with these grains was much lower (speed=200 ergs/cm$^2$ at D=1.0) than that of the element of Example II.

EXAMPLE IX

This example demonstrates the formation of silver iodide grains. The procedure of Example VII was repeated, the only exception being that zinc iodide was used instead of zinc bromide. The silver iodide grains were a deep yellow. A photothermographic element containing the photosensitive silver halide of this example was prepared and imaged according to the method of Example I. The speed of the photothermographic element formed with these grains was higher (speed=57 ergs/cm$^2$ at D=1.0) than that of the element of Example II.

EXAMPLE X

This example demonstrates how varying the number of incremental additions of silver source and halide source, while keeping the total amount of said sources constant, affects the speed of a photothermographic element containing the photosensitive silver halide.

In each run the initial silver halide nucleus was identical. The initial nucleus was formed by dissolving 2 g of silver nitrate powder and 10 g of polyvinyl butyral in 88 g of ethanol, and then adding an equimolar amount of zinc bromide. The solution was stirred continuously at 100 RPM and held at 20° C.

For each run, a total of 4 g of silver nitrate powder (45 μm mean particle size) and sufficient zinc bromide to neutralize that amount of silver nitrate were added to the solution containing the initial silver halide nucleus.

Each incremental addition was conducted as follows:

(4/n) g of silver nitrate powder were added to the solution (n=number of incremental additions per run). The solution was stirred for 15 minutes. Then sufficient zinc bromide, dissolved in ethanol, was added to neutralize the (4/n) g of silver nitrate. The solution was stirred for 15 minutes. Additions of (4/n) g of silver nitrate and sufficient zinc bromide to neutralize (4/n) g of silver nitrate were repeated until 4 g of silver nitrate had been added. After the final addition of zinc bromide, the solution was stirred for one hour. Then the silver halide was washed and dried. A photothermographic element containing the photosensitive silver halide of this example was prepared and imaged according to the method of Example I.

Table I sets forth the total amount of silver nitrate added, the total amount of zinc bromide added, the amount of silver nitrate in each incremental addition, the amount of zinc bromide in each incremental addition, and the speed of the photothermographic element prepared from the silver halide prepared in each run.

TABLE I

| Run | Number of additions | Total amount of $AgNO_3$ (g) | Total amount of $ZnBr_2$ (g) | Amount of $AgNO_3$ per addition (g) | Amount of $ZnBr_2$ per addition (g) | Speed[a] (ergs/cm$^2$) |
|---|---|---|---|---|---|---|
| 1 | 1 | 4 | 2.65 | 4 | 2.65 | 30.5 |
| 2 | 2 | 4 | 2.65 | 2 | 1.32 | 29.0 |
| 3 | 3 | 4 | 2.65 | 1.33 | 0.88 | 28.0 |
| 4 | 4 | 4 | 2.65 | 1 | 0.66 | 27.5 |
| 5 | 5 | 4 | 2.65 | 0.80 | 0.53 | 27.5 |
| 6 | 6 | 4 | 2.65 | 0.65 | 0.44 | 28.0 |
| 7 | 7 | 4 | 2.65 | 0.57 | 0.38 | 29.5 |
| 8 | 8 | 4 | 2.65 | 0.50 | 0.33 | 31.0 |
| 9 | 9 | 4 | 2.65 | 0.44 | 0.29 | 33.0 |
| 10 | 10 | 4 | 2.65 | 0.40 | 0.26 | 35.5 |
| 11 | 12 | 4 | 2.65 | 0.33 | 0.22 | 42.0 |
| 12 | 14 | 4 | 2.65 | 0.29 | 0.19 | 51.0 |

[a]Speed at D = 1.0

The foregoing results are respresented graphically in FIG. 1. It should be noted that in all cases, the value for the number of additions is always an integer, i.e., no value for the number of additions is ever a fraction.

This example shows that, under the conditions stated, maximum speed of a photothermographic element occurred with photosensitive silver halide that had been formed by employing four incremental additions of silver nitrate and zinc bromide. Furthermore, as the number of incremental additions increases, i.e. as n increases, so as to approach the condition of continuous addition, the speed of the photothermographic element containing the photosensitive silver halide decreases.

Various modifications and alterations of this invention become apparent to those skilled in the art without departing from the spirit and scope of this invention, and it should be understood that this invention is not to be limited to the illustrative embodiments set forth herein.

What is claimed is:

1. A photosensitive material consisting essentially of radiation-sensitive silver halide grains and a dry binder resin entrapping said grains said binder resin of said photosensitive material capable of being dissolved so that said photosensitive material can be added directly to a photothermographic system comprising a light-insensitive reducible metal compound and a reducing agent therefor, said silver halide grains having been formed by a process wherein ionizable silver salt and ionizable halide are introduced into a solution comprising said binder resin and an inert organic solvent to form initial silver halide nuclei, and additional ionizable silver salt and additional ionizable halide are introduced into said solvent in at least one incremental addition at such a rate that additional silver halide nuclei will not form more rapidly than the initial silver nuclei can grow.

2. The material of claim 1 wherein the resin is a polyvinyl acetal.

3. The material of claim 2 wherein the resin is polyvinyl butyral.

* * * * *